US006791049B2

(12) United States Patent
Yamazaki

(10) Patent No.: US 6,791,049 B2
(45) Date of Patent: Sep. 14, 2004

(54) ELECTRIC PART WITH CLICK FEELING

(75) Inventor: Kenji Yamazaki, Miyagi-ken (JP)

(73) Assignee: Alps Electric Co., Ltd., Tokyo (JP)

( * ) Notice: Subject to any disclaimer, the term of this patent is extended or adjusted under 35 U.S.C. 154(b) by 0 days.

(21) Appl. No.: 10/737,686

(22) Filed: Dec. 15, 2003

(65) Prior Publication Data

US 2004/0129541 A1 Jul. 8, 2004

(30) Foreign Application Priority Data

Dec. 25, 2002 (JP) ..... 2002-375274

(51) Int. Cl.[7] ..... H01H 19/14

(52) U.S. Cl. ..... 200/564; 200/548; 200/556; 200/565

(58) Field of Search ..... 200/11 R–11 H, 200/16 R–16 D, 537, 539, 547, 548, 564, 565, 570, 571, 336

(56) References Cited

U.S. PATENT DOCUMENTS 4,258,237 A * 3/1981 Beck ..... 200/11 J
4,737,602 A * 4/1988 Yamamoto ..... 200/16 D
4,825,020 A * 4/1989 Rao et al. ..... 200/16 D
5,010,214 A * 4/1991 Yamazaki ..... 200/6 B
6,236,002 B1 * 5/2001 Chou ..... 200/4
6,396,006 B1 * 5/2002 Yokoji et al. ..... 200/4

FOREIGN PATENT DOCUMENTS

JP 3037806 2/2000

* cited by examiner

*Primary Examiner*—Michael A. Friedhofer
(74) *Attorney, Agent, or Firm*—Beyer Weaver & Thomas, LLP

(57) ABSTRACT

An electric part with a click feeling comprises a click member, which includes sliding plate portions composed of a metal plate and a supporting plate portion for supporting the sliding plate portions. Each of the sliding plate portions has a sliding portion, on which a front end portion of an engaging and disengaging member slides, and a pair of bending portions which are provided at both ends of the sliding portion and are positioned on the sliding locus of the engaging and disengaging member. The bending portions of neighboring sliding plate portions of the plurality of sliding plate portions are opposite to each other at predetermined intervals and are held in one surface of the supporting plate portion, and the engaging and disengaging member fits into concave portions formed between the bending portions. Thus, since the engaging and disengaging member can move smoothly without getting caught in the bending portions, thereby lengthening it's life span.

9 Claims, 9 Drawing Sheets

ELECTRIC PART WITH CLICK FEELING

BACKGROUND OF THE INVENTION

1. Field of the Invention

The present invention relates to a sliding or rotary switch, or an electric part with a click feeling which is properly applicable to a variable resistor, and the like.

2. Description of the Related Art

A conventional electric part with a click feeling will be described with reference to the drawings. FIG. 16 is a principal cross-sectional view of the conventional electric part with the click feeling, FIG. 17 is an exploded perspective view of the conventional electric part with the click feeling, and FIG. 18 is a plan view of a code plate according to the conventional electric part with the click feeling.

Hereinafter, the structure of the conventional electric part with the click feeling will be explained referring to FIGS. 16 to 18. On the center of a shaft receiving body 51, a manipulating shaft 52 is rotatably attached and a code plate 53 is disposed so as to rotate together with the manipulating shaft 52.

The code plate 53 comprises a plurality of contact portions 54, which is composed of a metal plate and is disposed in a circular shape, a plurality of comb teeth-shaped portions 55, which is composed of a metal plate and is disposed in a circular shape outside the contact portions 54, and a supporting portion 56 made of an insulating material which supports the contact portions 54 and the comb teeth-shaped portions 55.

Further, the comb teeth-shaped portions 55 are formed by punching a metal plate, and concave portions are formed by notches 55*a* provided between the comb teeth-shaped portions 55, so that click portions K comprising the notches 55*a* and the comb teeth-shaped portions 55 are constructed.

A slider piece 58, which slides on contact portions 54, and a click spring 59, which is engaged with and is disengaged from the click portions K, are buried in and attached on a base 57 which is formed by molding synthetic resin.

Further, the base 57 is attached to a shaft receiving body 51 by an attachment plate 60 in a state where it is mounted on the rear surface of the shaft receiving body 51. Thus, when the manipulating shaft 52 rotates, the code plate 53 rotates, and consequently, the click spring 59 engages with and disengages from the click portions K, thereby rotating the manipulating shaft 52 with a click feeling. Furthermore, the slider piece 58 contacts or separates from the contact portions 54 to accomplish the switching of the contact points. (For example, see Japanese Patent No. 3037806)

Since in the conventional electric part with a click feeling, the click spring 59 engages with and disengages from the notches 55*a* and the comb teeth-shaped portions 55, which constitute the click portions K, the conventional electric part has a problem that the click spring 59 is caught by edges located at the notches 55*a* of the comb teeth-shaped portions 55, and thus the abrasion of the click spring 59 is noticeable and long serviceable life is unobtainable due to its large click operation.

Furthermore, in addition to the incapability of smooth operation, the conventional electric part has a problem that when the click spring 59 is caught by an edge, the tip portion of each comb teeth-shaped portion 55 is adapted to be a free end part, and thus during the engaging and disengaging of the click spring 59, the comb teeth-shaped portions 55 are pressed to suffer elastic deformation.

It also has a problem of loud sound during the click operation.

SUMMARY OF THE INVENTION

Accordingly, it is an object of the present invention to provide an electric part with a click feeling having a long serviceable life, a quiet click sound, and a smooth movement.

According to a first aspect of the present invention to solve the above-mentioned problems, an electric part with a click feeling comprises a click member having uneven click portions, and an engaging and disengaging member engaging with and disengaging from the click portions, wherein the click member includes a plurality of sliding plate portions composed of a metal plate and a supporting plate portion supporting the sliding plate portions, each of the sliding plate portions having a sliding portion, on which a front end portion of the engaging and disengaging member slides, and a pair of bending portions which are provided at both ends of the sliding portion and are positioned on the sliding locus of the engaging and disengaging member, wherein the bending portions of neighboring sliding plate portions of the plurality of sliding plate portions are opposite to each other at predetermined intervals, and the plurality of sliding plate portions are held in one surface of the supporting plate portion, thereby forming the click portions, and wherein the engaging and disengaging member slides on the sliding portions, and the engaging and disengaging member fits into concave portions formed between the bending portions of the neighboring sliding plate portions.

Furthermore, according to a second aspect of the present invention, the supporting plate portion is formed by molding synthetic resin, and the plurality of sliding plate portions is buried in and attached to the supporting plate portion.

Moreover, according to a third aspect of the present invention, the inner surfaces of the sliding portions and the bending portions of the sliding plate portions are supported by the supporting plate portion.

In addition, according to a fourth aspect of the present invention, the front end portions of the bending portions are buried in the supporting plate portion.

Furthermore, according to a fifth aspect of the present invention, the bending portions are slanted with respect to the sliding portions.

Moreover, according to a sixth aspect of the present invention, the sliding portions are formed in the shape of a convex curved surface.

In addition, according to a seventh aspect of the present invention, the plurality of sliding plate portions is connected to each other by coupling portions to form one metal plate.

Furthermore, according to an eighth aspect of the present invention, each of the coupling portions is provided on at least one end of the sliding portion positioned between a pair of the bending portions to connect the plurality of sliding plate portions to each other.

Moreover, according to a ninth aspect of the present invention, the engaging and disengaging member is formed of a plate spring having a convex portion formed thereon, and the convex portion is engaged with and disengaged from the click portions.

DESCRIPTION OF THE PREFERRED EMBODIMENTS

Figure 1:
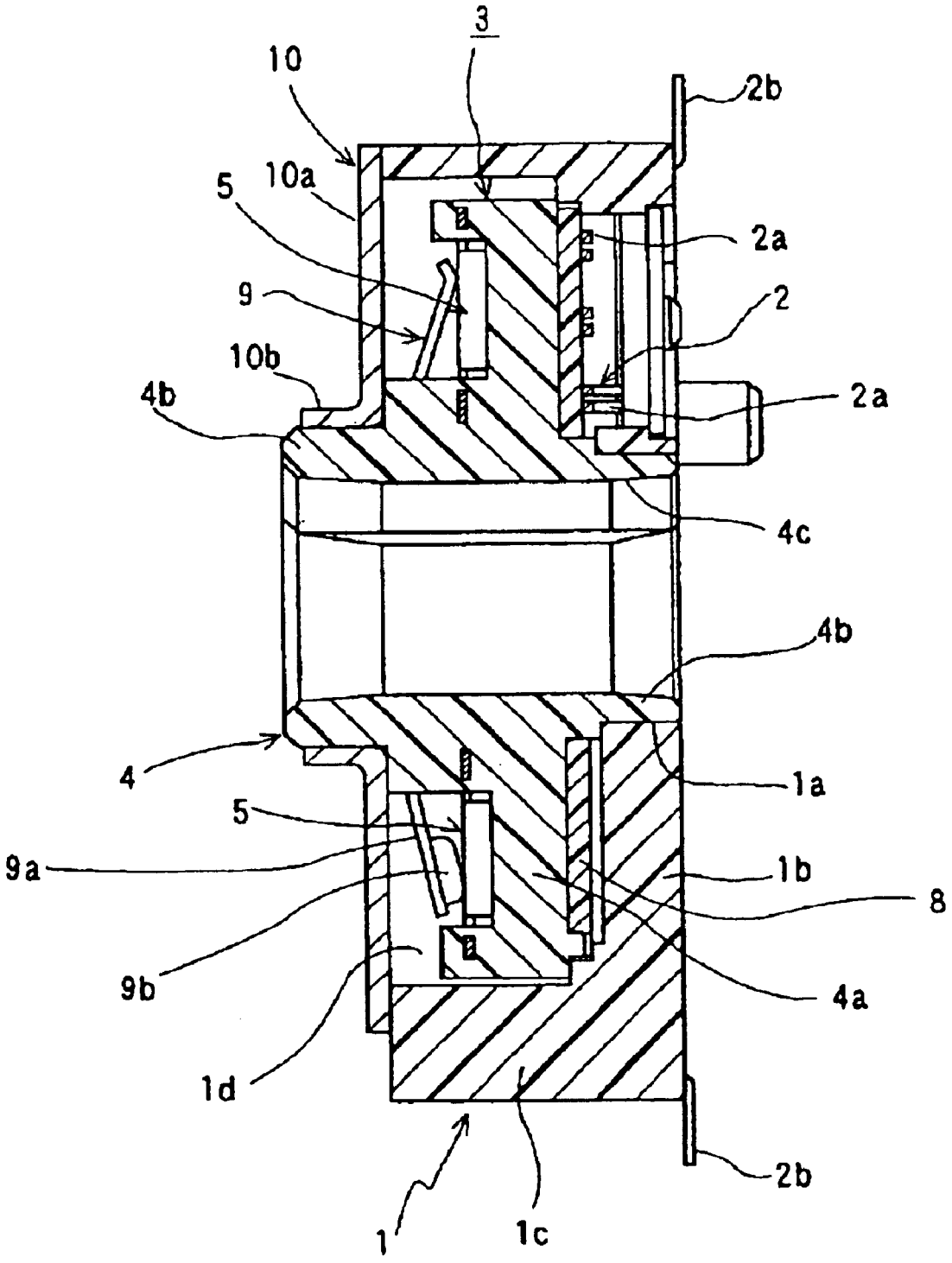
FIG. 1 is a principal cross-sectional view of a first embodiment of an electric part with a click feeling according to the present invention.
Figure 2:
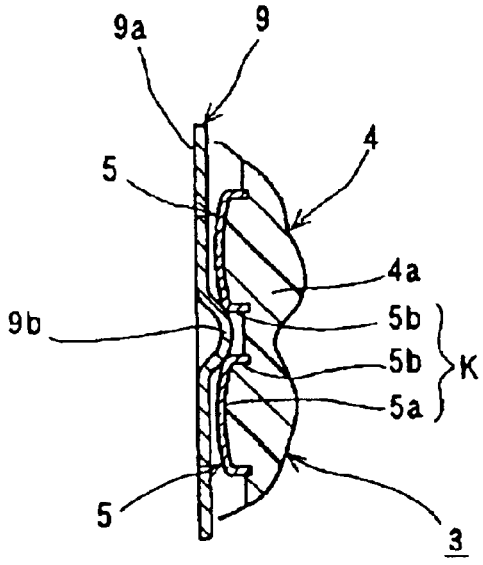
FIG. 2 is an enlarged principal cross-sectional view showing the relationship between click portions and an engaging and disengaging member according to the first embodiment of the electric part with the click feeling of the present invention.

An electric part with a click feeling of the present invention will now be described with reference to the accompanying drawings. FIG. 1 is a principal cross-sectional view according to a first embodiment of an electric part with a click feeling of the present invention. FIG. 2 is an enlarged principal cross-sectional view showing the relationship between click portions and an engaging and disengaging member according to a first embodiment of the electric part with the click feeling of the present invention.

Figure 3:
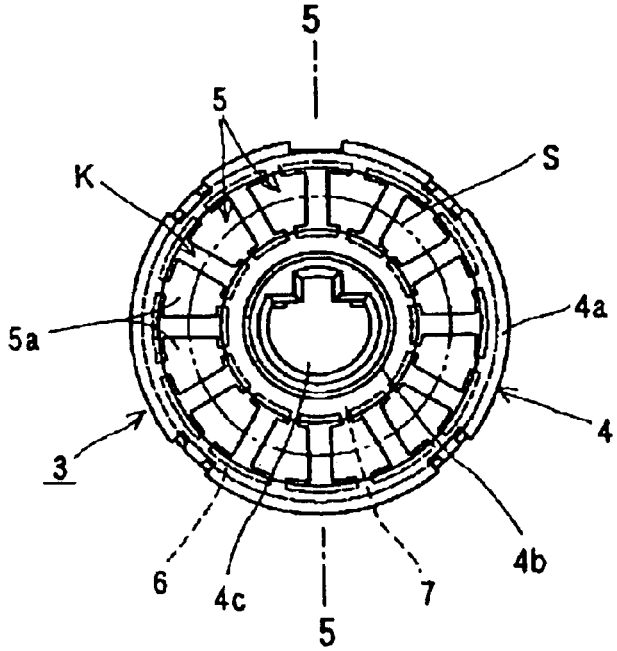
FIG. 3 is a plan view of a click member according to the first embodiment of the electric part with the click feeling of the present invention.
Figure 4:
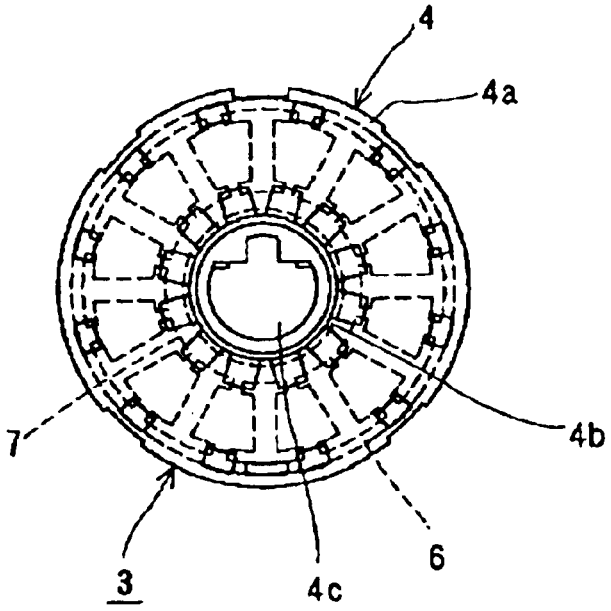
FIG. 4 is a bottom plan view of the click member according to the first embodiment of the electric part with the click feeling of the present invention.
Figure 5:
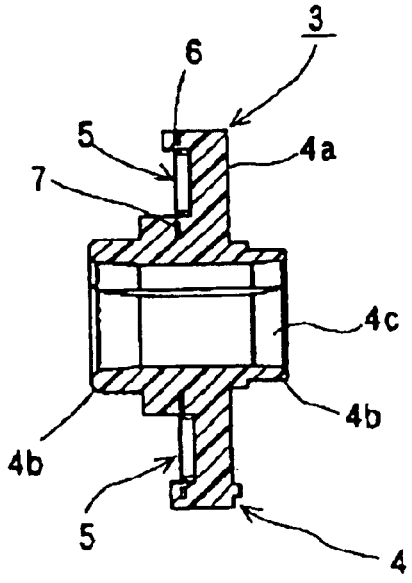
FIG. 5 is a cross-sectional view taken along the line 5—5 of FIG. 3.
Figure 6:
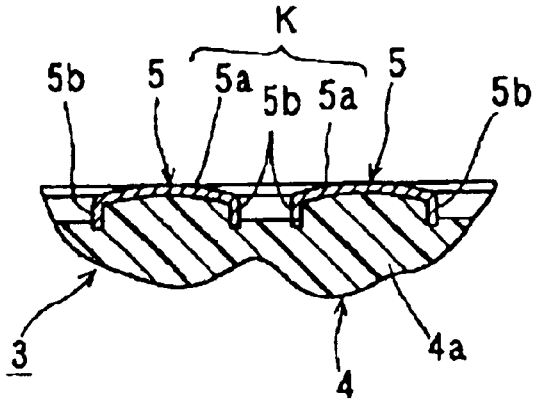
FIG. 6 is an enlarged principal cross-sectional view of the click member according to the first embodiment of the electric part with the click feeling of the present invention.

Furthermore, FIG. 3 is a plan view of a click member according to the first embodiment of the electric part with the click feeling of the present invention. FIG. 4 is a bottom plan view of the click member according to the first embodiment of the electric part with the click feeling of the present invention. FIG. 5 is a cross-sectional view taken along the line 5—5 of FIG. 3. FIG. 6 is an exploded principal cross-sectional view of the click member according to the first embodiment of the electric part with the click feeling of the present invention.

Figure 7:
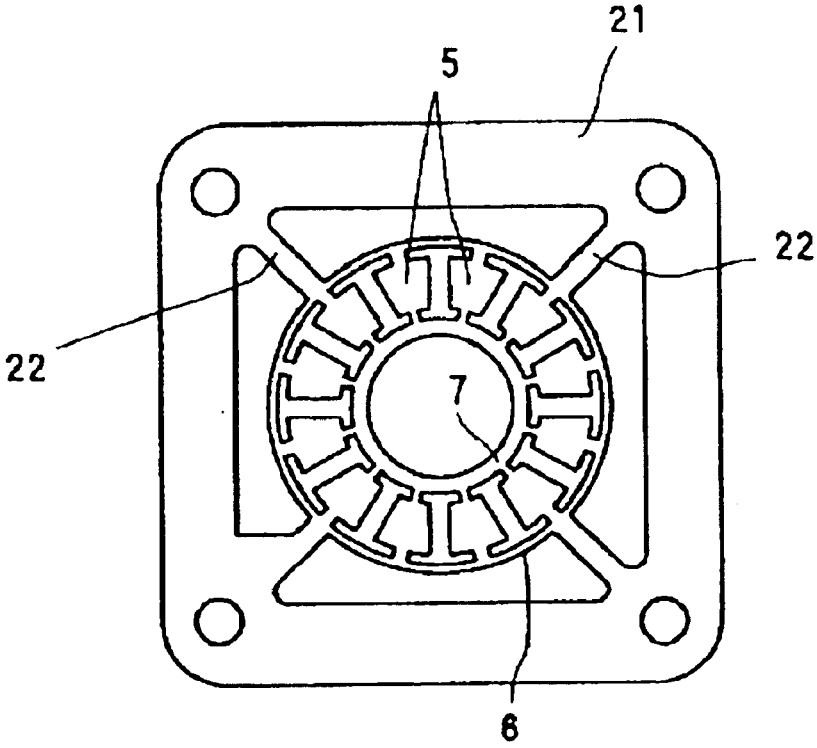
FIG. 7 is a plan view showing a first step of a method of manufacturing the click member according to the first embodiment of the electric part with the click feeling of the present invention.
Figure 8:
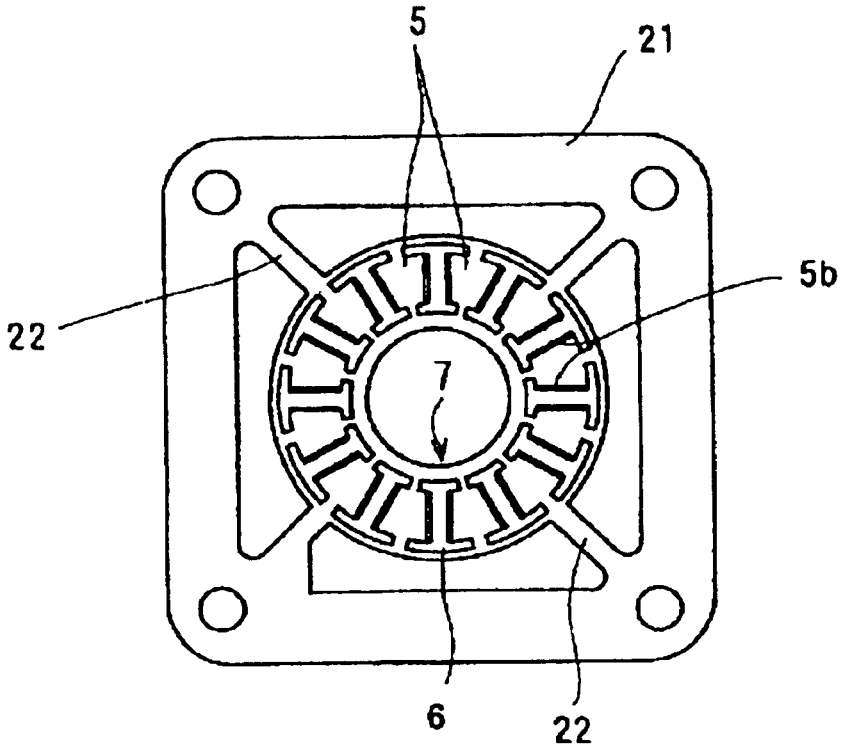
FIG. 8 is a bottom plan view showing the first step of the method of manufacturing the click member according to the first embodiment of the electric part with the click feeling of the present invention.
Figure 9:
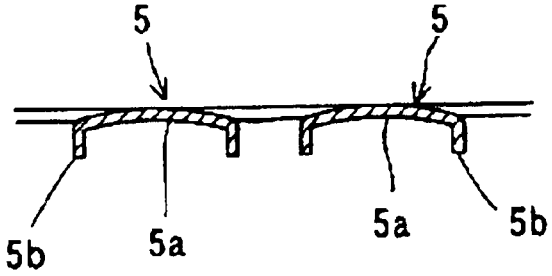
FIG. 9 is an enlarged principal cross-sectional view showing the first step of the method of manufacturing the click member according to the first embodiment of the electric part with the click feeling of the present invention.

Moreover, FIG. 7 is a plan view showing a first step of a method of manufacturing the click member according to the first embodiment of the electric part with the click feeling of the present invention. FIG. 8 is a bottom plan view showing the first step of the method of manufacturing the click member according to the first embodiment of the electric part with the click feeling of the present invention. FIG. 9 is an enlarged principal cross-sectional view showing the first step of the method of manufacturing the click member according to the first embodiment of the electric part with the click feeling of the present invention.

Figure 10:
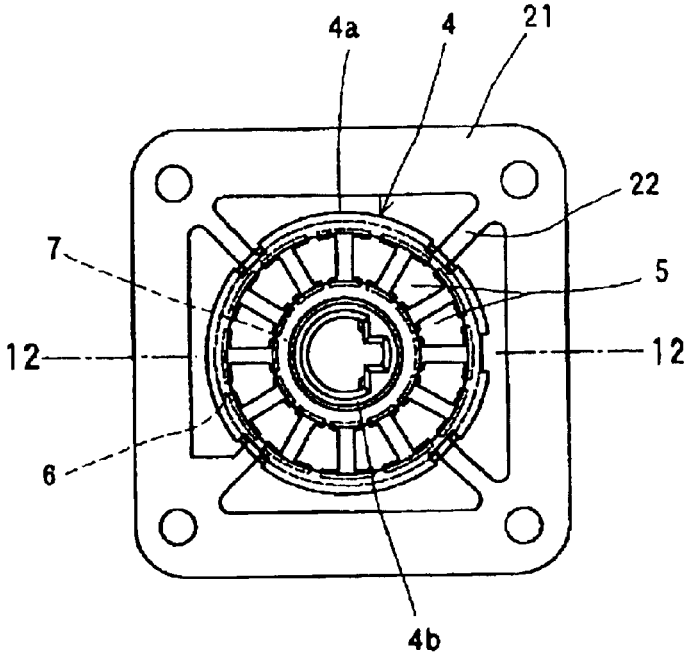
FIG. 10 is a plan view showing a second step of the method of manufacturing the click member according to the first embodiment of the electric part with the click feeling of the present invention.
Figure 11:
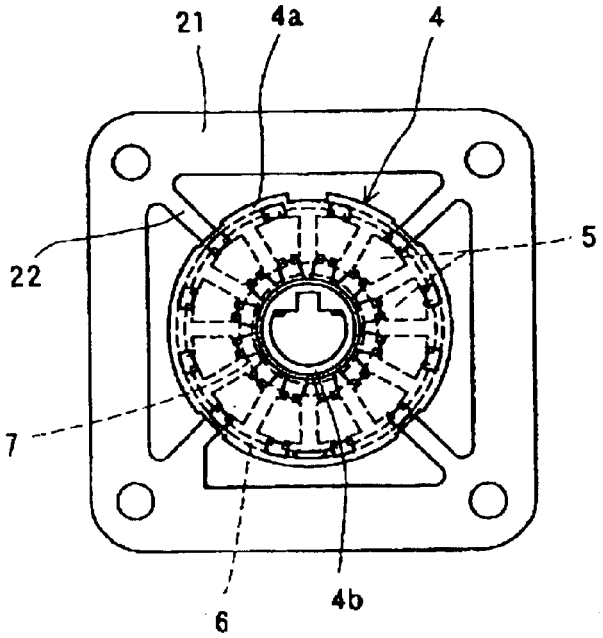
FIG. 11 is a bottom plan view showing the second step of the method of manufacturing the click member according to the first embodiment of the electric part with the click feeling of the present invention.
Figure 12:
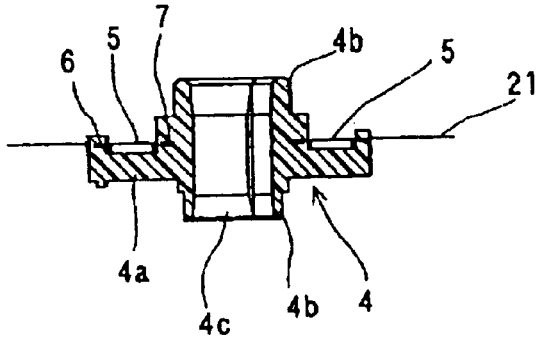
FIG. 12 is a cross-sectional view taken along line the 12—12 of FIG. 10.
Figure 13:
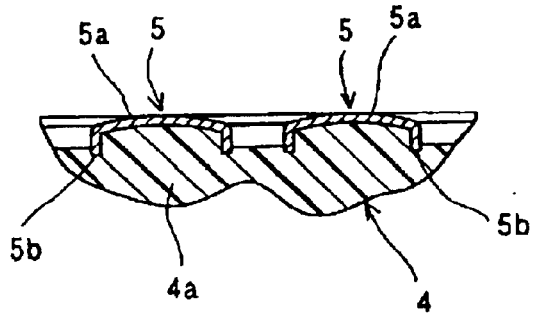
FIG. 13 is an enlarged principal cross-sectional view showing the second step of the method of manufacturing the click member according to the first embodiment of the electric part with the click feeling of the present invention.

In addition, FIG. 10 is a plan view showing a second step of the method of manufacturing the click member according to the first embodiment of the electric part with the click feeling of the present invention. FIG. 11 is a bottom plan view showing the second step of the method of manufacturing the click member according to the first embodiment of the electric part with the click feeling of the present invention. FIG. 12 is a cross-sectional view taken along the line 12—12 of FIG. 10. FIG. 13 is an enlarged principal cross-sectional view showing the second step of the method of manufacturing the click member according to the first embodiment of the electric part with the click feeling of the present invention.

Figure 14:
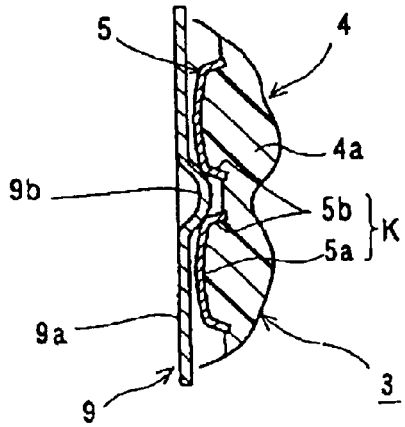
FIG. 14 is an enlarged principal cross-sectional view of a click member according to a second embodiment of the electric part with the click feeling of the present invention.
Figure 15:
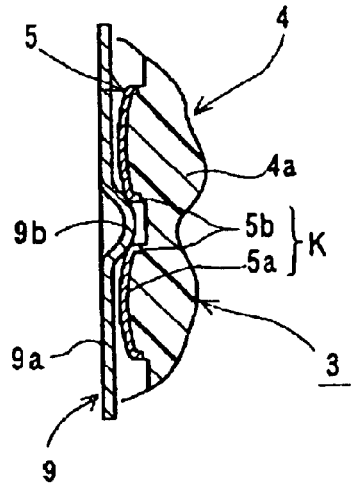
FIG. 15 is an enlarged principal cross-sectional view of a click member according to a third embodiment of the electric part with the click feeling of the present invention.
Figure 16:
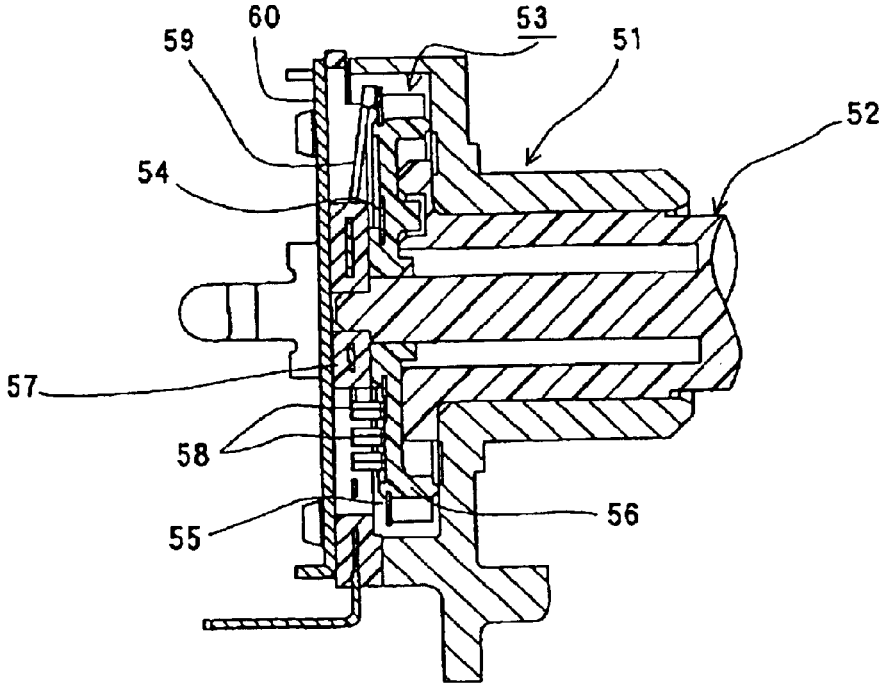
FIG. 16 PRIOR ART
FIG. 16 is a principal cross-sectional view of a conventional electric part with a click feeling.
Figure 17:
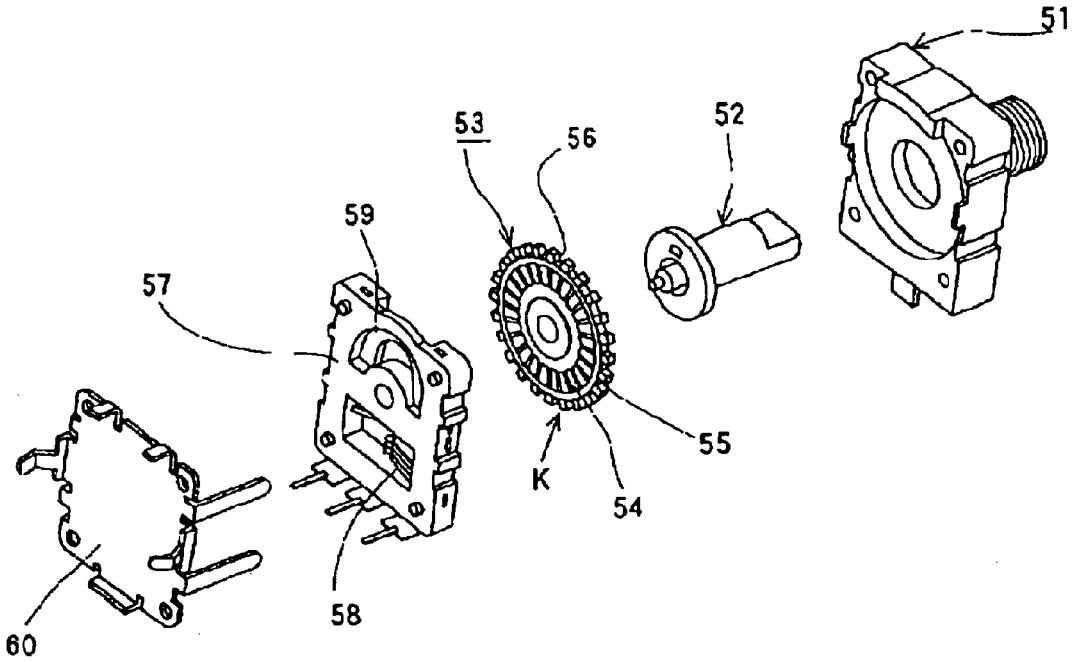
FIG. 17 PRIOR ART
FIG. 17 is an exploded perspective view of the conventional electric part with the click feeling.
Figure 18:
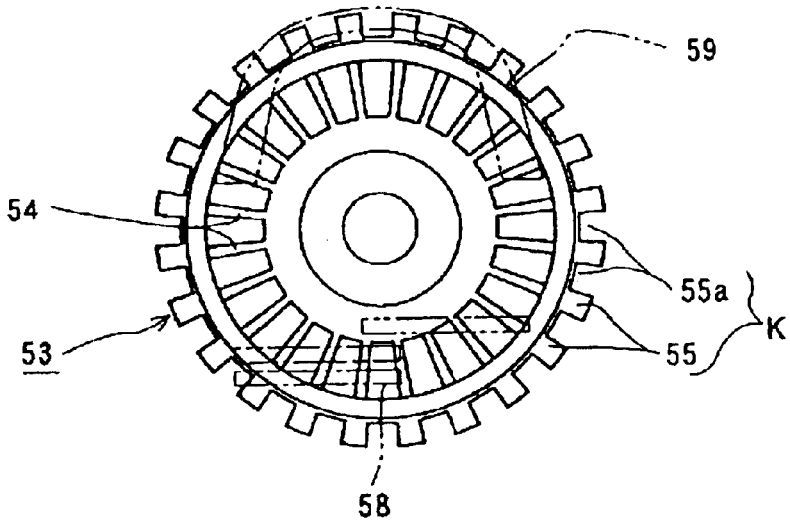
FIG. 18 PRIOR ART
FIG. 18 is a plan view of a code plate according to the conventional electric part with the click feeling.

Furthermore, FIG. 14 is an enlarged principal cross-sectional view of a click member according to a second embodiment of the electric part with the click feeling of the present invention. FIG. 15 is an enlarged principal cross-sectional view of a click member according to a third embodiment of the electric part with the click feeling of the present invention.

Hereinafter, as an example, the structure of the first embodiment of the electric part with the click feeling of the present invention applied to a rotary variable resistor will be explained referring to FIGS. 1 to 6. A box-shaped case 1, which is formed by molding synthetic resin, comprises a bottom wall 1*b* having a hole 1*a* in its center, a cylindrical side wall 1*c* extending from the circumference of the bottom wall 1*b* in a perpendicular direction, and an accommodating portion 1*d* having a concave shape surrounded by the bottom wall 1*b* and the side wall 1*c*.

A plurality of contact pieces 2 composed of elastic metal plates is buried in and attached on the case 1. The contact pieces 2 include contact portions 2*a* protruding into the accommodating portion 1*d* and terminals 2*b* protruding out of the case 1.

Furthermore, although not shown herein, in a state where the bottom wall 1*b* of the case 1 is mounted on a print board, the terminals 2 is soldered to a conduction pattern provided on the print board.

A substantially disc-shaped click member 3, particularly as shown in FIGS. 3 to 6, comprises a supporting plate portion 4 formed by molding synthetic resin and a plurality of sliding plate portions 5 held in the supporting plate portion 4.

Further, the supporting plate portion 4 includes a disc-shaped plate portion 4*a*, a shaft portion 4*b* protruding from the center of the plate portion 4*a* to both sides thereof, and a hole 4*c* provided at the center of the shaft portion 4*b* to insert a manipulating shaft (not shown).

Moreover, the plurality of sliding plate portions 5 is formed by punching a metal plate. Each sliding plate portion 5 includes a trapezoidal sliding portion 5*a* in the shape of a convex curved surface and a pair of bending portions perpendicularly bent from both ends of the sliding portion 5*a*.

Each of the plurality of sliding plate portions 5 is disposed in a circular shape at predetermined intervals, and in a state where the surface of the sliding portion 5*a* and a part of the bending portion 5*b* are exposed, they are buried and held in one surface of the plate portion 4*a* of the supporting plate portion 4 to adhere to the supporting plate portion 4.

Further, when the plurality of sliding plate portions 5 is attached, the bending portions 5*b* of neighboring sliding plate portions 5 are opposite to each other. In addition, as shown in FIG. 6, the inner surfaces of the sliding portions 5*a* and the bending portions 5*b* are supported by the supporting plate portion 4 (in a state where synthetic resin contacts the inner surfaces thereof), and the front end portions of the bending portions 5*b* are buried in the supporting plate portion 4.

With the above-mentioned structure, concave portions are formed between the sliding plate portions 5, and sliding portions 5*a* of the sliding plate portion 5 are formed in a convex shape. As a result, click portions K having an uneven shape are constructed.

Furthermore, ring-shaped coupling portions 6 are provided to connect the plurality of sliding plate portions 5, and each of the coupling portions 6 is provided at one end of the outer side of the sliding portion 5*a* disposed between a pair of bending portions 5*b*. In addition, ring-shaped coupling portions 7 are provided to connect the plurality of sliding plate portions 5, and each of the coupling portions 7 is provided at another end of the inner side of the sliding portion 5*a* positioned between a pair of bending portions 5*b*. Thus, the plurality of sliding plate portions 5 is unified.

Moreover, the plurality of sliding plate portions 5 is connected to each other by the coupling portions 6 and 7, so that their supporting strength is enhanced. In addition, the coupling portions 6 and 7 are buried in the plate-shaped portion 4*a* of the supporting plate portion 4, so that the supporting strength of the sliding plate portions 5 is further enhanced.

Further, only one of the coupling portions 6 and 7 may be formed.

A click member 3 formed as such is accommodated into the accommodating portion 1*d* of the case 1, and the shaft portion 4*b* is inserted into the hole 1*a*, so that it is rotatably supported.

Although not depicted, a lubricant, such as grease, is applied to the sliding plate portions 5.

Although not depicted, resistive elements and current collecting elements made of a conductive material are formed in one surface of a disc-shaped insulation substrate 8, and the insulation substrate 8 is held in one surface of the click member 3 in a state where it is positioned in the accommodating portion 1*d*. Thus, the insulating substrate 8 rotates together with the click member 3.

Further, when the insulation substrate 8 is attached, the contact portion 2*a* of the contact piece 2 slides to the resistor element and the current collecting element, respectively, so that a variable resistance value can be extracted from the terminals 2*b*.

An engaging and disengaging member 9 composed of a plate spring, such as a metal plate, and having an approximately annular shape includes a spring portion 9*a* and a convex portion 9*b* provided on the spring portion 9*a*. Furthermore, the engaging and disengaging member 9 is accommodated into the accommodating portion 1*d*, and the convex portion 9*b* is capable of being engaged with and disengaged from the click portions K.

A cover body 10 composed of a metal plate includes a plate-shaped portion 10*a* covering the opened portion of the case 1 and a cylindrical portion 10*b*, which holds the shaft portion 4*b* of the click member 3. In addition, the cover body 10 is attached to the case 1 to cover the opened portion of the case 1, and when the cover body 10 is mounted, it presses the spring portion 9*a* of the engaging and disengaging member 9 to elastically press the convex portion 9*b* onto the click portions K.

Furthermore, although not depicted herein, a pair of cylindrical protrusions is provided on the plate-shaped portion 10*a* by burring, and the protrusions are inserted into the holes provided on the engaging and disengaging member 9, whereby the engaging and disengaging member 9 is securely held in the cover body 10.

When the click member 3 rotates by a manipulating shaft (not shown), as described above, the insulation substrate 8 rotates, and the resistance value changed by the contact piece 2 is extracted.

Furthermore, when the click member 3 rotates, the convex portion 9*b* of the engaging and disengaging member 9 engages with and disengages from the click portions K, so that the click member 3 may rotate with a click feeling.

In addition, when the click member 3 rotates, the convex portion 9*b* moves while sliding on the sliding locus S shown as the two-dot chain line in FIG. 3, and the convex portion 9*b* slides while contacting the sliding portions 5*a* and the bending portions 5*b* bent from the sliding portions 5*a*. Thus, the convex portion 9*b* can move slippery and smoothly.

Moreover, the sliding portions 5*a* indicate places where the peak portion of the convex portion 9*b* slides, and the bending portions 5*b* indicate places where the peak portion of the convex portion 9*b* are sandwiched in the click positions of the click member 3 (a position shown in FIG. 2).

That is, a pair of the bending portions 5*b* provided on the sliding plate portion 5 are formed in a state where they are positioned on the sliding locus S.

In addition, although a rotary electric part has been described in the present embodiment, the present invention may also be applicable to a straight slide electric part.

Further, although the engaging and disengaging member composed of a plate spring has been described, the engaging and disengaging member may be formed of members other than the plate spring.

Moreover, the click member 3 may be non-movable, e.g., by attaching to the cover body, and the engaging and disengaging member 9 may be movable, e.g., by attaching to the supporting member 4.

Next, A manufacturing method of the click member of the present invention will be described with reference to FIGS. 7 to 13. As a first step, a metal plate 21 made of a hoop material is punched and bent to produce a semi-finished product including a plurality of sliding plate portions 5, which is positioned in a circular shape at predetermined intervals and each of which has a pair of bending portions 5*b*, coupling portions 7 connecting the inner sides of the sliding plate portions 5, and coupling portions 6 connecting the outer sides of the sliding plate portions 5, wherein the coupling portions 6 are connected to the metal plate 21 by piers 22.

Thereafter, as shown in FIGS. 10 to 13, in a second step, in a state where the surfaces of the sliding portions 5*a* and parts of the bending portions 5*b* are exposed, the supporting plate portion 4 is formed by molding synthetic resin so as to bury the sliding plate portions 5 and the coupling portions 6 and 7.

Subsequently, as the final step, the piers 22 are cut out along the periphery of the supporting plate portion 4 and are separated from the metal plate 21, and then the click member 3 is formed as shown in FIGS. 3 to 6.

Further, since both the engaging and disengaging member and the sliding portions 5 are made of metal in the present embodiment, they are superior in heat resistance compared with those made of synthetic resin.

Furthermore, FIG. 14 shows a second embodiment of the electric part with the click feeling of the present invention. In the second embodiment, a pair of the bending portions 5*b* provided on the sliding plate portions 5 are slanted with respect to the sliding portions 5*a*.

Since the structures of other elements are the same as that in the first embodiment, the same numerals designate the corresponding parts, and their explanation is omitted.

In the second embodiment, since the bending portions 5*b* are slanted, the engaging and disengaging member 9 moves more slippery and smoothly. Furthermore, at the time of forming, it is secured that the bending portions 5*b* are pressed (supported) on the slant by a metal mold, and it is easy to acquire the bending portions 5*b* having high precision.

Furthermore, FIG. 15 shows a third embodiment of the electric part with the click feeling of the present invention. In the third preferred embodiment, a pair of the bending portions 5*b* provided on the sliding plate portions 5 are shortened.

Since the structures of other elements are the same as that in the first embodiment, the same numerals designate the corresponding parts, and their explanation is omitted.

In the third embodiment, gaps between the sliding plate portions 5 are reduced, so that the number of clicks increases.

The electric part with the click feeling of the present invention comprises a click member having uneven click portions and an engaging and disengaging member which engages with and disengages from the click portions. The click member includes sliding plate portions composed of a metal plate and a supporting plate portion for supporting the sliding plate portions. Each of the sliding plate portions has a sliding portion, on which the front end portion of the engaging and disengaging member slides, and a pair of bending portions which are provided at both ends of the sliding portion and are positioned on the sliding locus of the engaging and disengaging member. The bending portions of neighboring sliding plate portions of the plurality of sliding plate portions are arranged to be opposite to each other at predetermined intervals, and the plurality of sliding plate portions is held in one surface of the supporting plate portion, thereby forming click portions. In addition, the engaging and disengaging member slides on the sliding portions, and the engaging and disengaging member fits into concave portions formed between the bending portions of the neighboring sliding plate portions.

Accordingly, since the engaging and disengaging member having the above construction slides on the bending portions of the sliding plate portions, the conventional problem that an edge part gets caught in concave portions does not occur, and thus a part's life can be lengthened.

In addition, the engaging and disengaging member moves slippery on the bending portions, and thus smoother movement is achieved. Further, the movement of the engaging and disengaging member toward the sliding plate portions is prevented by the supporting member, and the decrement of vibration can be easily attained, thereby suppressing a click.

Furthermore, since the supporting plate portion is formed by molding synthetic resin and the plurality of sliding plate portions is buried in the supporting plate portion, manufacturing thereof is simpler, productivity is enhanced, and lower cost is obtained.

Moreover, since the inner surfaces of the sliding portions and the bending portions of the sliding plate portions are supported by the supporting plate portion, the sliding portions and the bending portions are firmly supported. In addition, the sliding operation of the engaging and disengaging member on the sliding portions and the bending portions can be improved and stabilized, and a click sound can be suppressed.

Since the front end portions of the bending portions are buried in the supporting plate portion, the sliding plate portions are securely attached thereto, and the bending portions are securely supported. Therefore, the sliding operation of the engaging and disengaging member can be stabilized.

Moreover, a click sound can be reduced.

Furthermore, since the bending portions are slanted with respect to the sliding portions, the engaging and disengaging member moves more smoothly. In addition, at the time of forming, it is secured that the bending portions are pressed (supported) on the slant by a metal mold, and it is easy to acquire the bending portions 5*b* having high precision.

Moreover, since the top surfaces of the front end portions of the bending portions are covered by resin, they cannot be easily stripped off and can be securely held therein, and a click sound is reduced.

In addition, the operating force upon the click portion changes rapidly when the sliding portions are formed in a flat surface shape. However, since the surfaces of the sliding portions are formed in the shape of a convex curved surface, the operating force upon the click portion changes gradually, thereby generating no incongruity in the operation of the click portion.

Since the angle formed between the side surface of the engaging and disengaging member and the sliding plate portions is gentle, a click sound can be reduced.

Furthermore, since the plurality of sliding plate portions is connected to each other by coupling portions to form one metal plate, the sliding plate portions can be simply attached, and productivity is enhanced, thereby lowering a manufacturing cost.

Moreover, since each of the coupling portions is provided at one end or both ends of the sliding portion positioned between a pair of the bending portions in order to connect the plurality of sliding plate portions, the sliding portions can be securely supported, and the sliding operation of the engaging and disengaging member can be stabilized.

In addition, since the engaging and disengaging member is formed of a plate spring having a convex portion formed thereto and the convex portion is engaged with and disengaged from the click portions, the engaging and disengaging member can be simply manufactured, and it's life can be lengthened particularly when the engaging and disengaging member is formed of a plate spring.

What is claimed is:

1. An electric part with a click feeling, comprising:

a click member having uneven click portions, and an engaging and disengaging member engaging with and disengaging from the click portions, wherein the click member includes a plurality of sliding plate portions composed of a metal plate and a supporting plate portion for supporting the sliding plate portions, each of the sliding plate portions having a sliding portion, on which a front end portion of the engaging and disengaging member slides, and a pair of bending portions which are provided at both ends of the sliding portion and are positioned on the sliding locus of the engaging and disengaging member, wherein the bending portions of neighboring sliding plate portions of the plurality of sliding plate portions are opposite to each other at predetermined intervals, and the plurality of sliding plate portions are held in one surface of the supporting plate portion, thereby forming the click portions, and wherein the engaging and disengaging member slides on the sliding portions and fits into concave portions formed between the bending portions of the neighboring sliding plate portions.

2. An electric part with a click feeling according to claim 1, wherein the supporting plate portion is formed by molding synthetic resin, and wherein the plurality of sliding plate portions is buried in and attached to the supporting plate portion.

3. An electric part with a click feeling according to claim 2, wherein the inner surfaces of the sliding portions and the bending portions of the sliding plate portions are supported by the supporting plate portion.

4. An electric part with a click feeling according to claim 3, wherein the front end portions of the bending portions are buried in the supporting plate portion.

5. An electric part with a click feeling according to claim 3, wherein the bending portions are slanted with respect to the sliding portions.

6. An electric part with a click feeling according to claim 2, wherein the sliding portions are formed in the shape of a convex curved surface.

7. An electric part with a click feeling according to claim 1, wherein the plurality of sliding plate portions is connected to each other by coupling portions to form one metal plate.

8. An electric part with a click feeling according to claim 7, wherein each of the coupling portions is provided on at least one end of the sliding portion positioned between a pair of the bending portions to connect the plurality of sliding plate portions to each other.

9. An electric part with a click feeling according to claim 1, wherein the engaging and disengaging member is formed of a plate spring having a convex portion formed thereon, and the convex portion is engaged with and disengaged from the click portions.

* * * * *